US005282537A

United States Patent [19]

Wong

[11] Patent Number: 5,282,537

[45] Date of Patent: Feb. 1, 1994

[54] COMBINATION PHOTO FRAME, GIFT BOX AND GREETING CARD

[76] Inventor: Hammond Y. Wong, 2121 W. Mission Rd. Ste. #308, Alhambra, Calif. 91803

[21] Appl. No.: 926,839

[22] Filed: Aug. 7, 1992

[51] Int. Cl.[5] ..... B65D 73/00; B65D 5/52

[52] U.S. Cl. ..... 206/485; 217/11; 206/45.14; 206/45.17; 206/45.28; 40/312; 40/155

[58] Field of Search ..... 40/155-530, 40/312-537; 206/45.14, 45.17, 45.28, 44.11, 485; 217/58, 9, 10, 11

[56] References Cited

U.S. PATENT DOCUMENTS 2,331,361 10/1943 Tuttle et al. ..... 206/45.28 X
4,371,077 2/1983 Solitt et al. ..... 206/45.14
4,887,709 12/1989 Shimamine .

FOREIGN PATENT DOCUMENTS 4423 2/1907 United Kingdom ..... 40/312

*Primary Examiner*—William I. Price
*Attorney, Agent, or Firm*—Ladas & Parry

[57] ABSTRACT

The invention is a combination gift article that simultaneously provides the features of a photo frame, gift box and greeting card. It is comprised of two swivably connected panels that open and close with respect to each other, much like the covers of a book or greeting card. One or both of the panels may have means for mounting and displaying a photograph, and with both panels opened with respect to each other, serve as a photo frame. The combination gift article has a gift container mounted on one of the panels that may contain a small gift and/or a photograph. Preferably the gift container is in the shape of a heart. The combination gift article may also have inscribed on a panel or the gift container a greeting or message for the receiver of the gift.

22 Claims, 4 Drawing Sheets

COMBINATION PHOTO FRAME, GIFT BOX AND GREETING CARD

FIELD OF THE INVENTION

This invention pertains to the field of gift items, and more particularly to a combination gift item that simultaneously and conveniently provides the features of a photo frame, gift box and greeting card.

BACKGROUND OF THE INVENTION

Photo frames have been known for many years. They are often given as gifts on birthdays, anniversaries, Christmas and other special occasions. However before giving the photo frame, the presenter often must comply with the age-old custom of gift-wrapping the article, that is, placing the frame in a box and wrapping it in attractive wrapping paper and pretty ribbon. A greeting card would then be attached to the gift-wrapped frame to communicate to the receiver the reason for his or her receiving the gift.

The foregoing is comprised of three separate acts. The first act is that of selecting and purchasing a gift, namely a photo frame. The second act is that of gift-wrapping the photo frame. This may consist of taking the purchased frame to the courtesy wrapping section of a department store and perhaps payment of a service fee to have it wrapped. Alternatively, it may consist of purchasing a box, a roll of wrapping paper, transparent tape and ribbon for wrapping the gift at home. In either case, this second step requires additional effort, time and expense. The third act is that of selecting, purchasing, annotating, and signing a greeting card that will accompany the gift and apprise the receiver of the reason he or she is receiving it. Like the second step, the third act entails additional effort, time and expense.

SUMMARY OF THE INVENTION

The present invention combines the features of a photo frame, a gift box and a greeting card and provides a convenient and tasteful means of giving a thoughtful gift.

In its preferred embodiment, the invention has a first panel and a second panel. The two panels are swivably connected and together take the general form of a conventional greeting card. A gift container is provided which may be removably secured to the second panel and which is visible through an aperture in the first panel. The aperture and the gift container are similarly shaped so that a portion of the gift container would be accommodated through the aperture in a fitted manner. Both the aperture and gift container are preferably shaped in a meaningful form such as a heart. The gift container itself comprises of a base and cover and is large enough to contain a necklace, bracelet or some other like item. An inscription may be placed on a panel surface to represent a greetings message to the receiver of the gift.

BRIEF DESCRIPTION OF THE DRAWINGS

In describing the invention, reference will be made to the accompanying drawings wherein.

DETAILED DESCRIPTION

Figure 1:
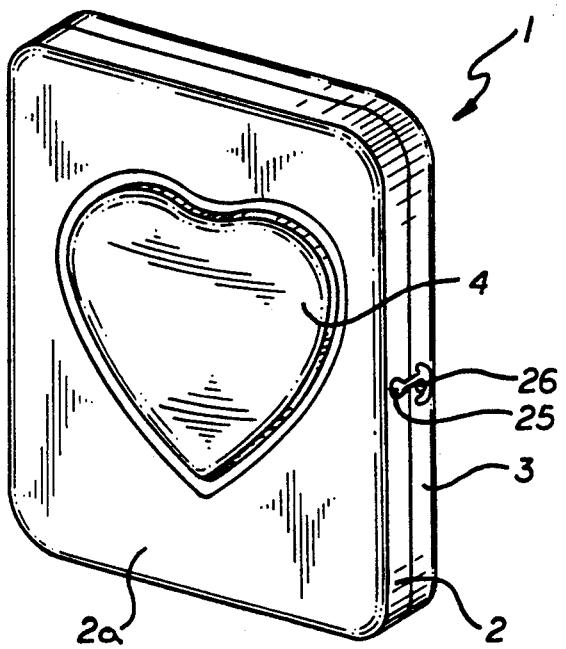
FIG. 1 is a perspective view of the combination photo frame, gift container and greeting card.

Referring now to the drawings, there is illustrated in FIG. 1 a view of the combination photo frame, gift box and greeting card that comprises the invention 1. The invention 1 has a first panel 2, a second panel 3 and a gift container 4. The first panel has a first side 2*a* and a second side 2*b*. First side 2*a* is visible in FIG. 1.

Figure 2:
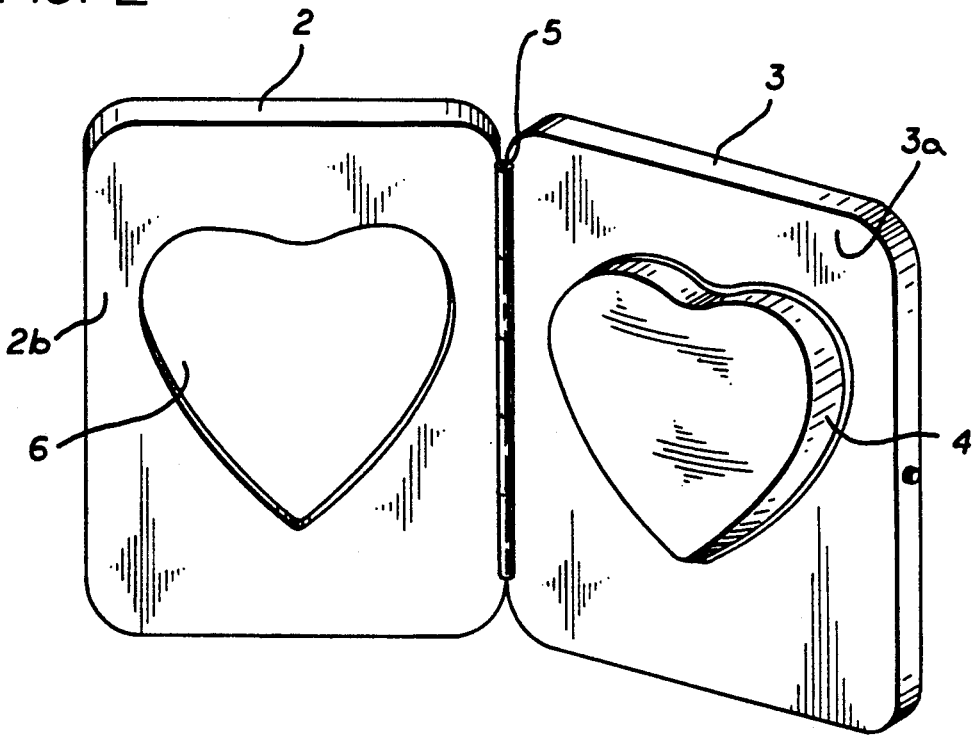
FIG. 2 depicts the invention where the two panels are opened away from each other.

As can be seen in FIG. 2, the panels 2 and 3 are swivably connected by hinge connection means 5 so that the panels may be opened and displaced from each other from one end much like the two pages of a conventional greeting card. The second side 2*b* of first panel 2 is seen in FIG. 2. Located in first panel 2 is first aperture 6. Second panel 3 has first side 3*a* and second side 3*b*. Second panel first side 3*a* is seen in FIG. 2 while second panel second side 3*b* can be seen in FIG. 4. Removably disposed on second panel 3 is gift container 4. Gift container 4 is of the same general configuration as first aperture 6 so that when panels 2 and 3 are adjacent to each other like the closed pages of a greeting card, the front portion of gift container 4 neatly and fittingly protrudes through first aperture 6. This can be seen in FIG. 1. In the preferred embodiment, both the gift container 4 and first aperture 6 are in the shape of a heart. However other shapes and configurations can be adapted for use.

It is not necessary that a portion of gift container 4 protrude through first aperture 6 as described in the foregoing paragraph. Alternatively, the gift container could be made with a minimized depth so that, although the gift container 4 may be viewed through first aperture 6, it may not protrude therethrough when first panel 2 and second panel 3 are closed with respect to each other.

Figure 3:
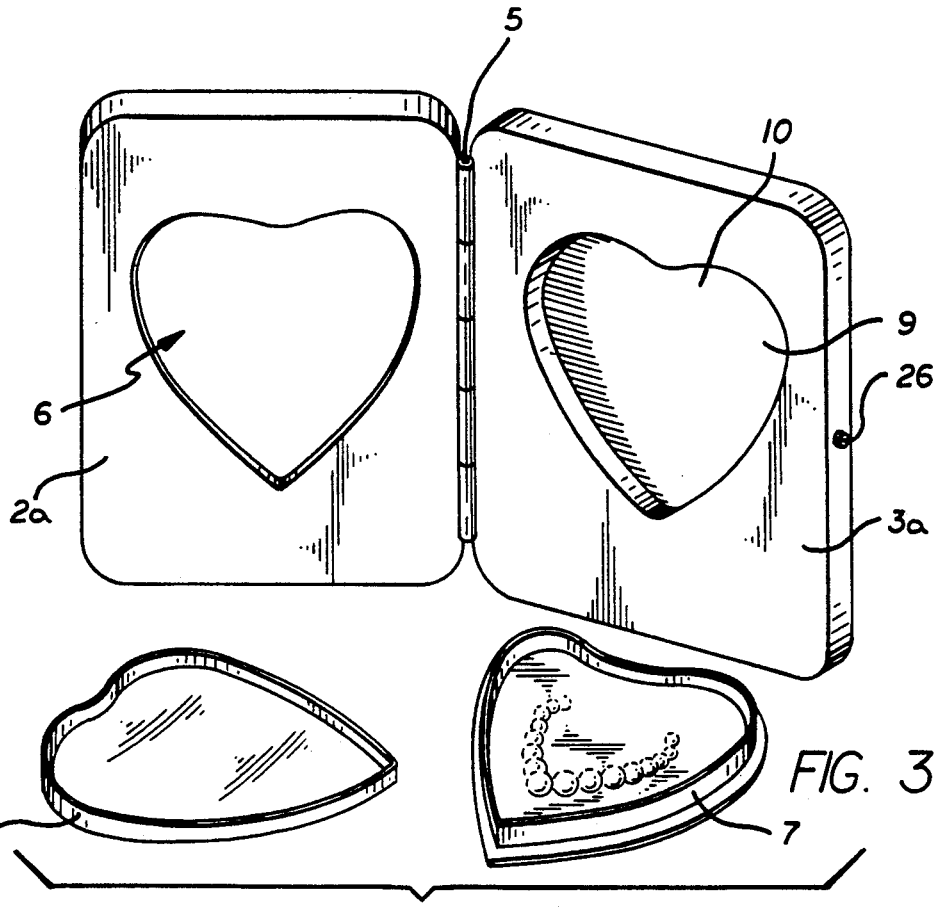
FIG. 3 shows the invention with the gift container removed from the second panel and the cover displaced from the base.

FIG. 3 illustrates the invention wherein the gift container 4 is removed from the second panel 3. The gift container 4 has a base 7 and cover 8. A necklace, bracelet, ring or other gift item may be placed in the gift container 4. The removal of gift container 4 from the second panel leaves back panel 9 open to view through second aperture 10.

Figure 4:
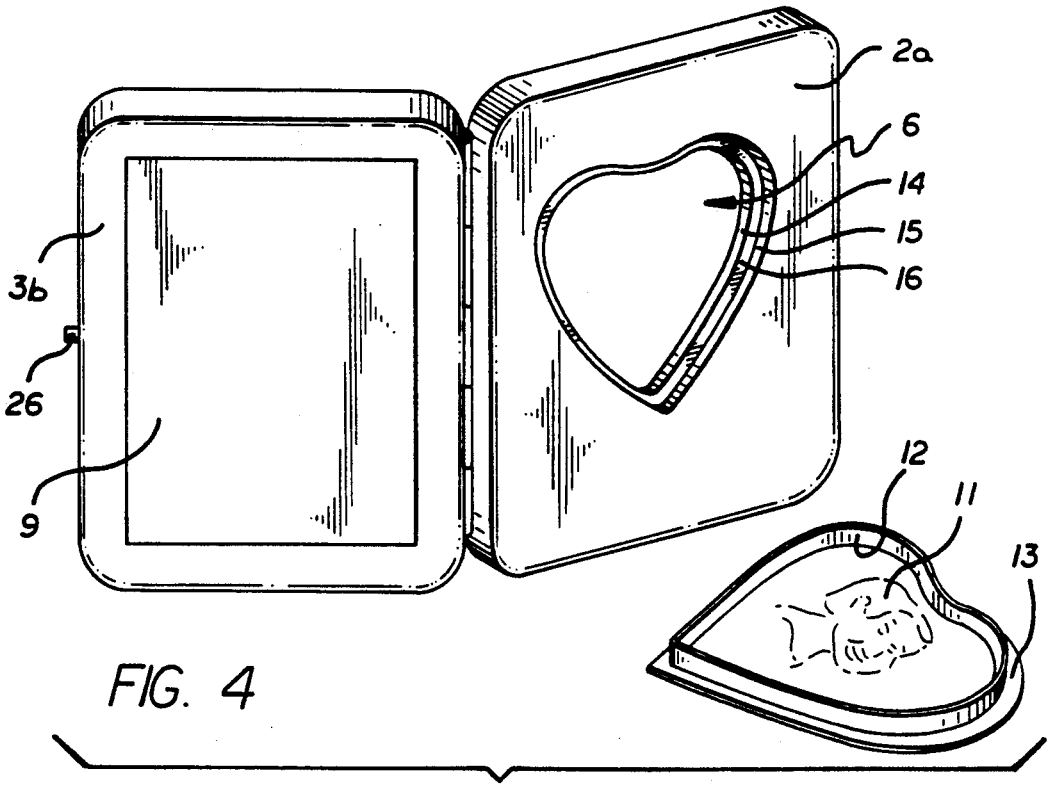
FIG. 4 is a view of the invention where the panels are opened and viewed from a perspective opposite that illustrated in FIG. 3.

Back panel 9 is more fully depicted in FIG. 4. In FIG. 4, the first panel 2 and second panel 3 are seen from a perspective opposite that in FIG. 3. From this viewpoint, first panel first side 2*a* and second panel second side 3*b* are seen. The base 7 has a photograph 11 disposed thereon. The base 7 has a side portion 12 and a flange portion 13. As can be seen in FIG. 4, first aperture 6 formed on first panel 2 is comprised of a first periphery 14 and a second periphery 15 that cannot be seen when viewing first panel second side 2*b*. The surface formed between the first periphery 14 and the second periphery 15 is restraining wall 16. As will be further described, when the base 7 is inserted from first panel first side 2a, flange portion 13 is restrained by the abutment of flange portion 13 against restraining wall 16.

Figure 5:
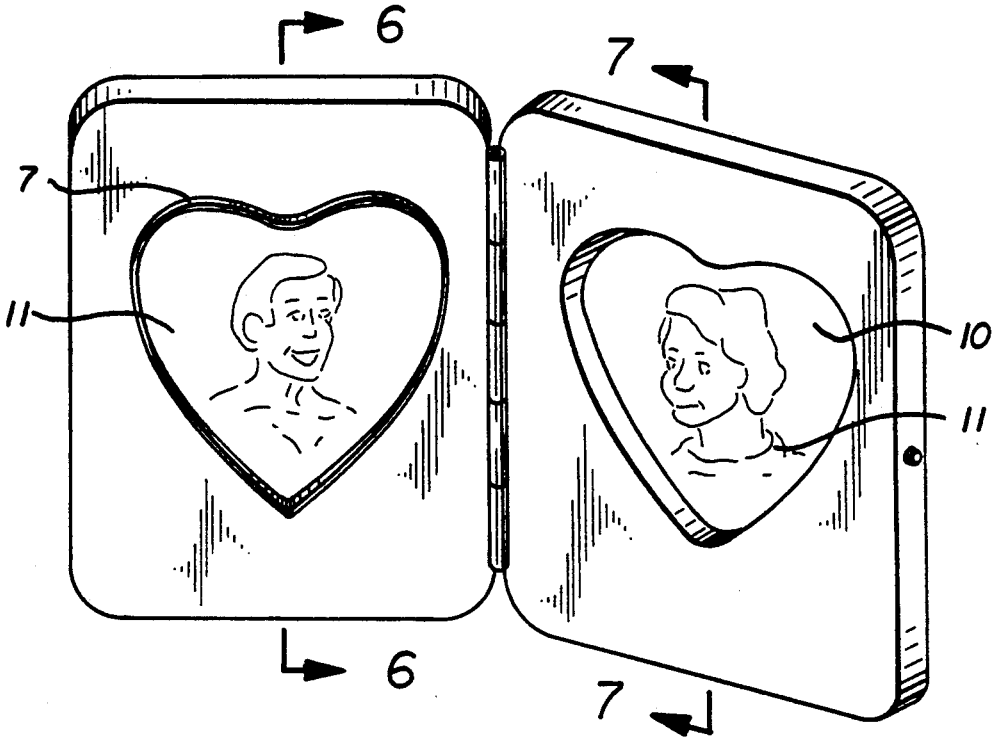
FIG. 5 is a view of the invention in a position of use as a photo frame.

FIG. 5 shows the invention in use as a photo frame. As described in the foregoing paragraph, base 7 is inserted through aperture 6 from first panel first side 2a and restrained by restraining wall 16. A photograph 11 has been mounted on the base 7. Another photograph 11 has been mounted on back panel 9 and can be seen through second aperture 10.

Figure 6:
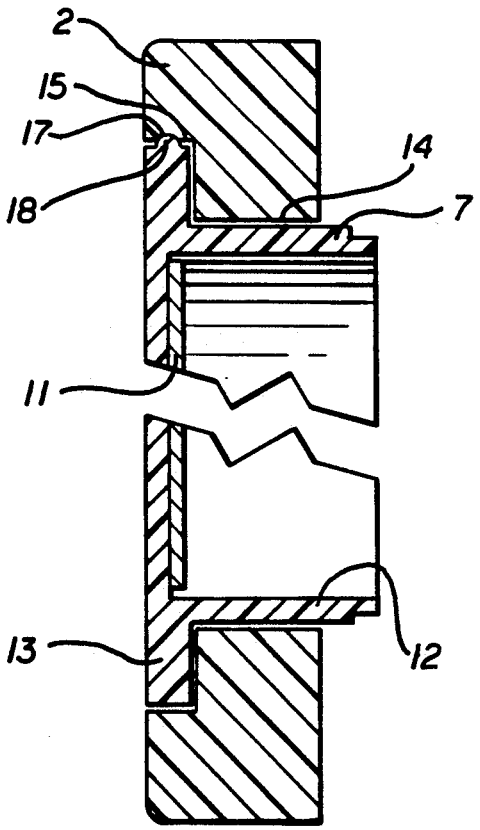
FIG. 6 is a cross-sectional view through line 6—6 of FIG. 5.

FIG. 6 is a cross-sectional view through line 6—6 of FIG. 5. This illustrate one manner of coupling base 7 in first aperture 6 by the use of groove 17 formed on second periphery 15 and protruding bead member 18. When base 7 is placed in first aperture 6, protruding bead member 18 brought to confront against a portion of first panel first side 2a. The exertion of a small amount of force will cause the protruding bead member 18 to snap into place into groove 17 and securely hold base 7 in first aperture 6. A plurality of grooves 17 may be symmetrically spaced on second periphery 15 with corresponding protruding bead members 18 located on base 7 for stable fitting of base 7 on first panel 2. Also seen in FIG. 6 is photograph 11 mounted onto the base 7.

It is to be understood that for purposes of clearly illustrating the invention, the drawings do not necessarily depict the various components in their relative proportions. For example, in FIG. 6, flange portion 13, relative to sidewall 12, is depicted to be thicker than preferred in the preferred embodiment.

Figure 7:
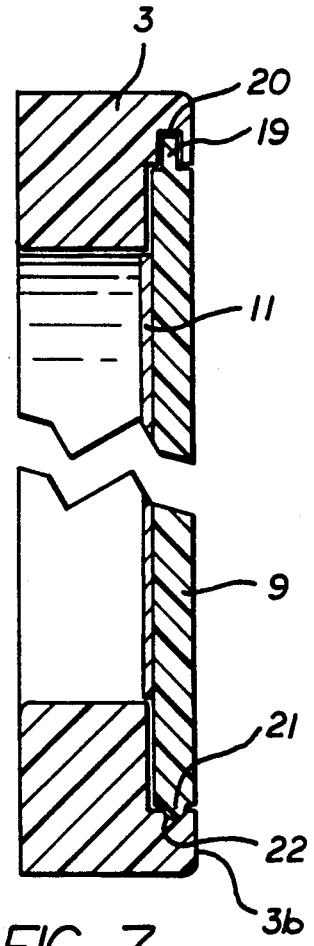
FIG. 7 is a cross-sectional view through line 7—7 of FIG. 5.

A cross-sectional view through line 7—7 of FIG. 5 is seen in FIG. 7. This depicts one means by which back panel 9 is secured into position on the second panel 3. The back panel 9 has a tab 19 on its upper end and second panel 3 has a corresponding slot 20 into which tab 19 can be inserted. On the opposite end, back panel 9 has a second protruding member 21 which corresponds with second groove 22. A photograph 11 is disposed onto back panel 9. The back panel 9 is then secured to second panel 3 by inserting tab 19 into slot 20. Second protruding member 21 is then brought to confront a portion of second panel second side 3b. By exerting force to bear the second protruding member 21 against second panel second side 3b, the second protruding member 21 will snap into place in second groove 22. This is only one means of securing back panel 9 to second panel 3. There are certainly numerous other methods to achieving the same result that will be evident to one skilled in the art.

Figure 8:
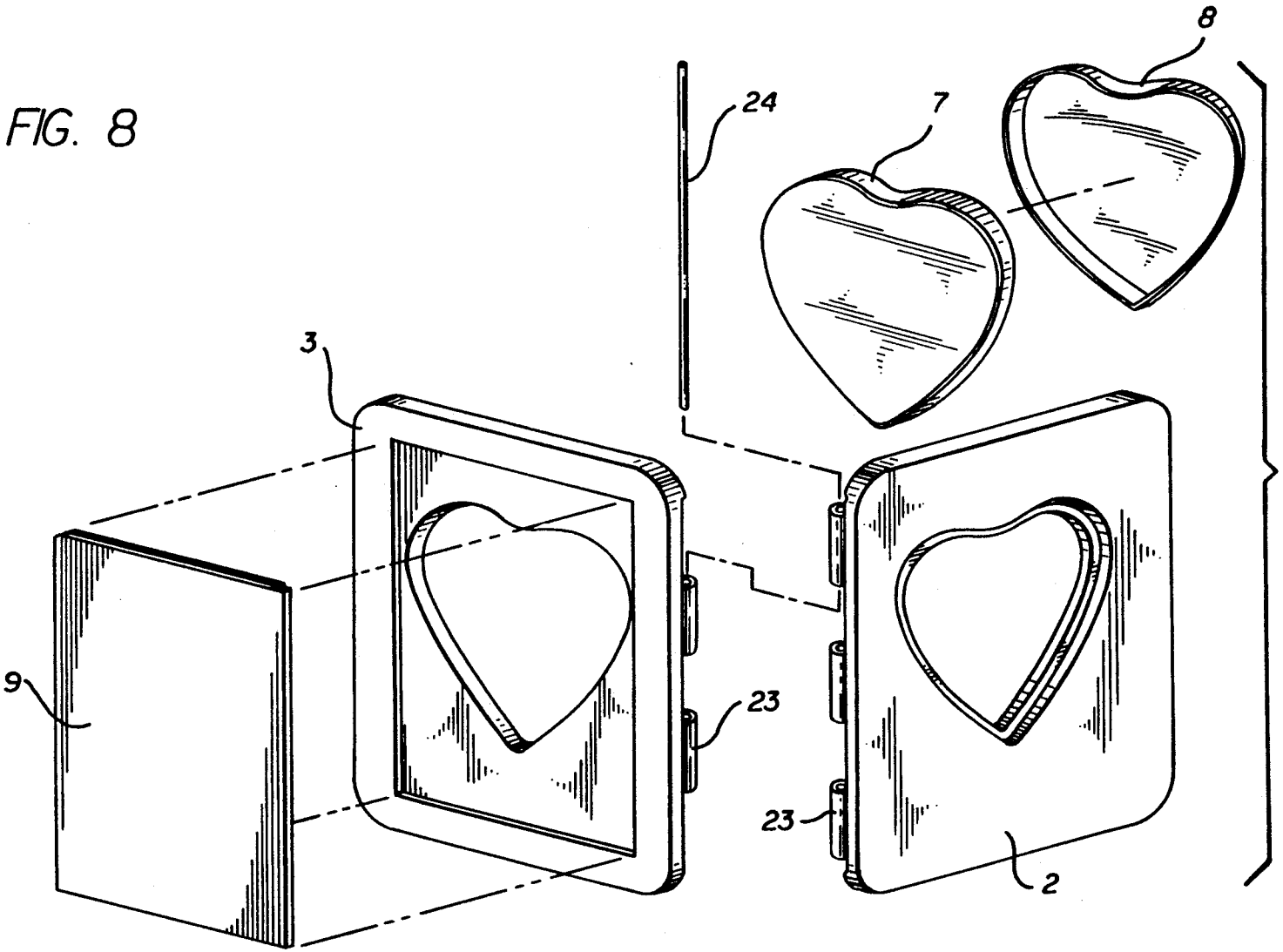
FIG. 8 is an exploded view of the invention.

FIG. 8 is an exploded view of the invention that illustrates the constituent parts of the preferred embodiment. This view best illustrates connection means 5 as comprised of hinge enclosures 23 and hinge rod 24. By aligning the axis of hinge enclosures 23 of the first panel 2 with those of the second panel 3 and inserting the hinge rod 24 therethrough, the two panels are swivably connected. However there are numerous other conventional methods of connecting the two panels 2 and 3 to permit the panels to displace with respect to each other like the pages of a greeting card. The use of hinge enclosures 23 and hinge rod 24 is described for exemplary purposes and is by no means limiting.

Panels 2 and 3 may be made from any assortment of materials including plastic, wood or metal. However it is preferably made of marble or some other stone that may be polished to give the invention 1 an aura of enhanced value. The gift container 4 may similarly be made of different types of material but in the preferred embodiment it is made of plastic. At least the protruding bead members 18 should be made from a plastic or other elastic material so that they will yield when the gift container 4 is snapped into place on first panel 2.

First aperture 6, gift container 4 and second aperture 10 are similarly shaped except first aperture 6 is of slightly smaller diameter than flange portion 13. The shape formed by side portion 12 and cover 8 is in turn slightly smaller than first aperture 6 so that they may be inserted through first aperture 6. Second aperture 10 must be slightly larger than the profile of flange portion 13 so that the gift container 4 may fit in the aperture opening.

In actual use, a photograph or jewelry item, or both, may be placed in the gift container 4. Where gift container 4 is to contain both, a divider may be placed between the photograph and the jewelry item. The divider may have fasteners to hold the jewelry item in place. After the photograph and jewelry item are in place, cover 8 is affixed to the gift container base 7. The gift container 4 is then inserted onto the second aperture 10 where it sits abutting the back panel 9. First panel 2 is then swung to close against second panel 3 with the front portion of the gift container 4 protruding through first aperture 6. The gift container may then be presented to a recipient in this form. Alternatively, ribbon may be tied around the invention 1 before such presentation. A hook 25 attached to one panel, that may be fastened to a pin 26 on the other panel (as depicted in FIG. 1), may also be provided to keep first panel 2 and second panel 3 together.

The recipient upon receiving the invention will open the two panels 2 and 3 to discover the gift container 4. The gift container 4 is removed from where it sits on the second aperture 10. The cover 8 is removed from the base 7 to expose the contents therein, either a photograph 11, a piece of jewelry, or both. After removal of the jewelry and, if used, the divider, the base 7 with photograph 11 thereon is brought in through first aperture 6 from first panel first side 2a. A second photograph 11 is viewable through second aperture 10. The first panel 2 and second panel 3, opened like the pages of a greeting card and at less than 180 degrees to each other, may be placed on and made to stand on their bottom edges. The invention 1 has been converted into a photo frame with both photographs viewable.

The drawings and the foregoing description are not intended to represent the only form of the invention in regard to the details of its construction and manner of operation. In fact, this apparatus and method can be adapted to a great many different situations. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

The invention is claimed as follows:

1. A combination photo frame, gift box and greeting card comprising:

two panels, comprising a first panel and a second panel;

means for swivably connecting said two panels to each other;

a gift container; and means for removably mounting said gift container onto one of said two panels.

2. A combination photo frame, gift box and greeting card as claimed in claim 1 wherein said first panel has a first aperture through which said gift container is viewed.

3. A combination photo frame, gift box and greeting card comprising:

two panels, comprising a first panel and a second panel;

means for swivably connecting said two panels to each other;

a gift container;

means for removably mounting said gift container onto one of said two panels;

said first panel has a first aperture through with said gift container is viewed, said first aperture and said gift container are similarly shaped so that said first aperture may accommodate a portion of said gift container in a fitted manner.

4. A combination photo frame, gift box and greeting card as claimed in claim 1 wherein said gift container is removably mounted onto said second panel.

5. A combination photo frame, gift box and greeting card as claimed in claim 3 further comprising a back panel and means for securing said back panel to said second panel, said second panel having a second aperture shaped substantially similar to a portion of said gift container so that said gift container may be seated into said second aperture to abut against said back panel.

6. A combination photo frame, gift box and greeting card as claimed in claim 5 wherein said gift container is comprised of a base and a cover, said base having a side portion and a flange portion extending from said side portion, said cover snugly fitting onto said side portion and said flange portion seated into said second aperture to abut against said back panel.

7. A combination photo frame, gift box and greeting card as claimed in claim 6 wherein said first aperture is comprised of a first periphery and a second periphery, said first periphery of lesser diameter than said second periphery, said two peripheries separated by a restraining wall, wherein when said gift container is removed from said second panel, said cover is removed from said base, and said base is inserted into said first aperture, said side portion will fit through said first periphery but said flange portion will abut against said restraining wall and not fit through said first periphery.

8. A combination photo frame, gift box and greeting card as claimed in claim 7 further comprising said flange portion having at least one protruding member on an outlying surface and said second periphery having formed thereon a first groove corresponding to said protruding member so that when said flange portion is brought to confront against first panel first side, said protruding member will contact against a surface of said first panel first side but wherein the application of a minimal force would cause said protruding member to be seated into said groove so that said base is stably held onto said first panel.

9. A combination photo frame, gift box and greeting card as claimed in claim 8 wherein said securing means is comprised of said back panel having a tab at a first end of said back panel, a slot formed to accept said tab on said second panel, said back panel having a second protruding member corresponding to a second groove formed on said second panel so that when said tab is inserted into said slot, and said second protruding member is brought to confront against a surface of said second panel, the application of a minimal force will cause said protruding member to be seated into said second groove so that said back panel will be stably held onto said second panel.

10. A combination photo frame, gift box and greeting card as claimed in claim 1, wherein said panels are made from stone.

11. A combination photo frame, gift box and greeting card as claimed in claim 1, wherein said stone is marble.

12. A combination photo frame, gift box and greeting card as claimed in claim 1 wherein said panels are made from wood.

13. A combination photo frame, gift box and greeting card as claimed in claim 1 wherein said panels are made from a plastic material.

14. A combination photo frame, gift box and greeting card as claimed in claim 1 further comprising a message inscribed on at least one of said panels.

15. A combination photo frame, gift box and greeting card as claimed in claim 1 further comprising a message inscribed on said gift container.

16. A gift item combining the attributes of a photo frame, gift box and greeting card, said item comprising:

a first panel and a second panel;

means to connect said first panel to said second panel so that said first panel and said second panel would swivably open and close with respect to each other like the pages of a greeting card;

a gift container having a base and a cover;

means for removably mounting said gift container onto said second panel;

said first panel having an aperture formed thereon, said first panel having means to mount said base near said aperture.

17. A gift item as claimed in claim 16 further comprising a back panel and means to attach said back panel to said second panel, a second aperture formed on said second panel so that when a photograph is placed between said back panel and said second panel, the photograph is viewable through said second aperture.

18. A gift item as claimed in claim 17 wherein said means to attach said first panel and said second panel is comprised of hinge enclosures formed in a staggered manner on said first and said second panels so that when said hinge enclosures of said first and second panels are aligned, a hinge pin is inserted into said aligned hinge enclosures to swivably connect said first panel with said second panel.

19. A gift item combining the attributes of a photo frame, gift box and greeting card, said item comprising:

a first panel and a second panel; said first panel having a first aperture formed thereon and said second panel having a second aperture formed thereon;

hinge enclosures formed on said first panel and hinge enclosures formed on said second panel, said hinge enclosures on said first panel formed in a staggered relationship with said hinge enclosures on said second panel so that when said first panel and said second panel are disposed adjacent to each other, said hinge enclosures of said first panel and said hinge enclosures of said second panel are linearly arranged;

a hinge rod inserted through said linear arrangement of hinge enclosures to swivably connect said first panel to said second panel so that said first panel and said second panel would swivably open and close with respect to each other like the pages of a greeting card;

a back panel and means for securing said back panel to said second panel;

a gift container having a base and a cover, said base having a side portion and a flange portion extending from said side portion, said cover fitting onto said side portion and said flange portion seated into said second aperture to abut against said back panel;

means for removably mounting said gift container onto said second panel so that a portion of said gift container will protrude through said aperture when said gift container is mounted onto said second panel and said first panel and said second panel are swivably closed with respect to each other;

said first panel having means to mount said flange of said base near said first aperture; and a message inscribed on one of said panels.

20. A combination photo frame, gift box and greeting card comprising:

two panels, comprising a first panel and a second panel;

means for swingably connecting said two panels to each other;

a gift container comprising an enclosure; and means for removably mounting said gift container onto one of said two panels.

21. A combination photo frame, gift box and greeting card as claimed in claim 20 wherein said mounting means is comprised of snap action means.

22. A combination photo frame, gift box and greeting card comprising:

two panels, comprising a first panel and a second panel, said first panel having an aperture formed thereon, said aperture having a groove formed thereon;

means for swivably connecting said two panels to each other;

a gift container having a base, said base having a bead member formed thereon such that when said base is placed within said aperture, said groove corresponds to said bead member and the exertion of a small amount of force causes said groove to receive said bead member therewithin.

* * * * *